US008307980B1

(12) United States Patent
Kao

(10) Patent No.: US 8,307,980 B1
(45) Date of Patent: Nov. 13, 2012

(54) BIT SOCKET BRACKET ASSEMBLY

(76) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 13/344,719

(22) Filed: Jan. 6, 2012

(51) Int. Cl.
*B65D 85/00* (2006.01)
*A47F 7/00* (2006.01)

(52) U.S. Cl. ..... 206/378; 206/493; 206/372; 211/70.6

(58) Field of Classification Search ..... 206/378, 206/493, 303, 372, 377, 376, 1.5, 807, 806, 206/349; 211/70.6, 69, 69.5, 94.01
See application file for complete search history.

(56) References Cited

U.S. PATENT DOCUMENTS

| | | | | |
|---|---|---|---|---|
| 6,092,656 | A * | 7/2000 | Ernst | 206/378 |
| 6,415,933 | B1 * | 7/2002 | Kao | 211/70.6 |
| 6,508,360 | B1 * | 1/2003 | Chen | 206/378 |
| 6,669,032 | B2 * | 12/2003 | Kao | 211/70.6 |
| 6,698,600 | B1 * | 3/2004 | Lee | 211/70.6 |
| 6,854,607 | B2 * | 2/2005 | Tong | 211/70.6 |
| 7,066,339 | B2 * | 6/2006 | Chiu et al. | 211/70.6 |
| 7,861,871 | B2 * | 1/2011 | Kao | 211/70.6 |
| 8,205,758 | B2 * | 6/2012 | Shih | 211/70.6 |
| 2003/0024837 | A1 * | 2/2003 | Chen | 206/378 |
| 2003/0070999 | A1 * | 4/2003 | Kao | 211/70.6 |
| 2003/0102275 | A1 * | 6/2003 | Kao | 211/70.6 |
| 2003/0141211 | A1 * | 7/2003 | Tsai | 206/378 |
| 2003/0213760 | A1 * | 11/2003 | Lee | 211/70.6 |
| 2004/0188366 | A1 * | 9/2004 | Tong | 211/70.6 |
| 2006/0261018 | A1 * | 11/2006 | Kao | 211/70.6 |
| 2009/0145865 | A1 * | 6/2009 | Yu | 211/70.6 |
| 2010/0133213 | A1 * | 6/2010 | Kao | 211/70.6 |
| 2010/0170817 | A1 * | 7/2010 | Wu | 206/378 |
| 2012/0138553 | A1 * | 6/2012 | Kao | 211/70.6 |

* cited by examiner

*Primary Examiner* — Steven A. Reynolds
(74) *Attorney, Agent, or Firm* — patenttm.us

(57) ABSTRACT

A bit socket bracket assembly has a main frame, a track frame, multiple bit socket brackets and a burglarproof unit. The main frame is made of plastic. The track frame is made of metal and is securely mounted on the main frame. The bit socket brackets are slidably connected with the track frame. The burglarproof unit is connected with each bit socket bracket. Because the main frame and the track frame are two separate members, the track frame can be made of metal. Accordingly, the structural strength of the bit socket bracket assembly is enhanced. Moreover, signs formed on the track frame do not easily wear off.

4 Claims, 17 Drawing Sheets

BIT SOCKET BRACKET ASSEMBLY

BACKGROUND OF THE INVENTION

1. Field of the Invention

The present invention relates to a bit socket bracket assembly, and more particularly to a bit socket bracket assembly having an enhanced structural strength.

2. Description of Related Art

A conventional bit socket bracket assembly is completely made of plastic and has a weaker structural strength compared to a metallic bit socket bracket assembly. Signs, such as "13 mm (millimeter)," formed on the plastic bit socket bracket assembly are easily worn off.

However, the bit socket bracket assembly completely made of metal is heavy and expensive although the signs are clear and durable.

To overcome the shortcomings, the present invention tends to provide a bit socket bracket assembly to mitigate the aforementioned problems.

SUMMARY OF THE INVENTION

The main objective of the invention is to provide a bit socket bracket assembly having an enhanced structural strength.

A bit socket bracket assembly has a main frame, a track frame, multiple bit socket brackets and a burglarproof unit. The main frame is made of plastic. The track frame is made of metal and is securely mounted on the main frame. The bit socket brackets are slidably connected with the track frame. The burglarproof unit is connected with each bit socket bracket. Because the main frame and the track frame are two separate members, the track frame can be made of metal. Accordingly, the structural strength of the bit socket bracket assembly is enhanced. Moreover, signs formed on the track frame do not easily wear off.

Other objects, advantages and novel features of the invention will become more apparent from the following detailed description when taken in conjunction with the accompanying drawings.

DETAILED DESCRIPTION OF PREFERRED EMBODIMENT

Figure 1:
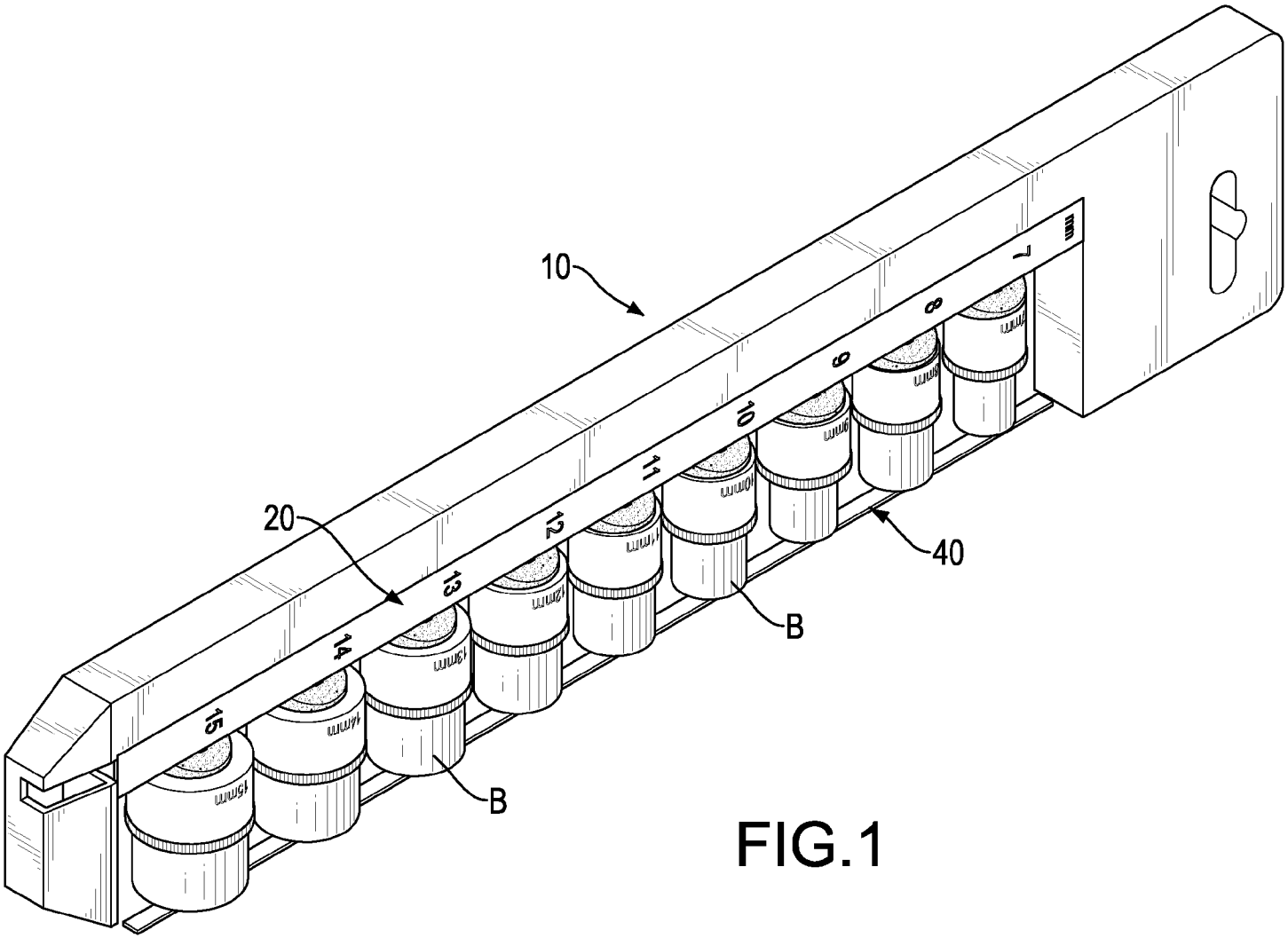
FIG. 1 is a perspective view of a first embodiment of a bit socket bracket assembly in accordance with the present invention.

With reference to FIGS. 1, 2, 10 and 11, a first embodiment of a bit socket bracket assembly in accordance with the present invention comprises a main frame 10, a track frame 20, multiple bit socket brackets 30 and a burglarproof unit 40.

The main frame 10 is made of plastic and has a base plate 11, an arm 12, a limiting member 13 and a frame space 14.

The base plate 11 has a hanging hole 111 formed through the base plate 11.

The arm 12 is integrally mounted on the base plate 11 and has a length, an extending direction, a side surface, a mounting strip 121 and a distal end. The side surface of the arm 12 is elongated. The mounting strip 121 protrudes from the side surface of the arm 12. The distal end of the arm 12 is opposite to the base plate 11.

The limiting member 13 is integrally mounted on the distal end of the arm 12 and has a tool channel 131 formed through the limiting member 13. The frame space 14 is formed between the base plate 11, the arm 12 and the limiting member 13 and has a rectangular cross section. The mounting strip 121 is located in the frame space 14.

Figure 2:
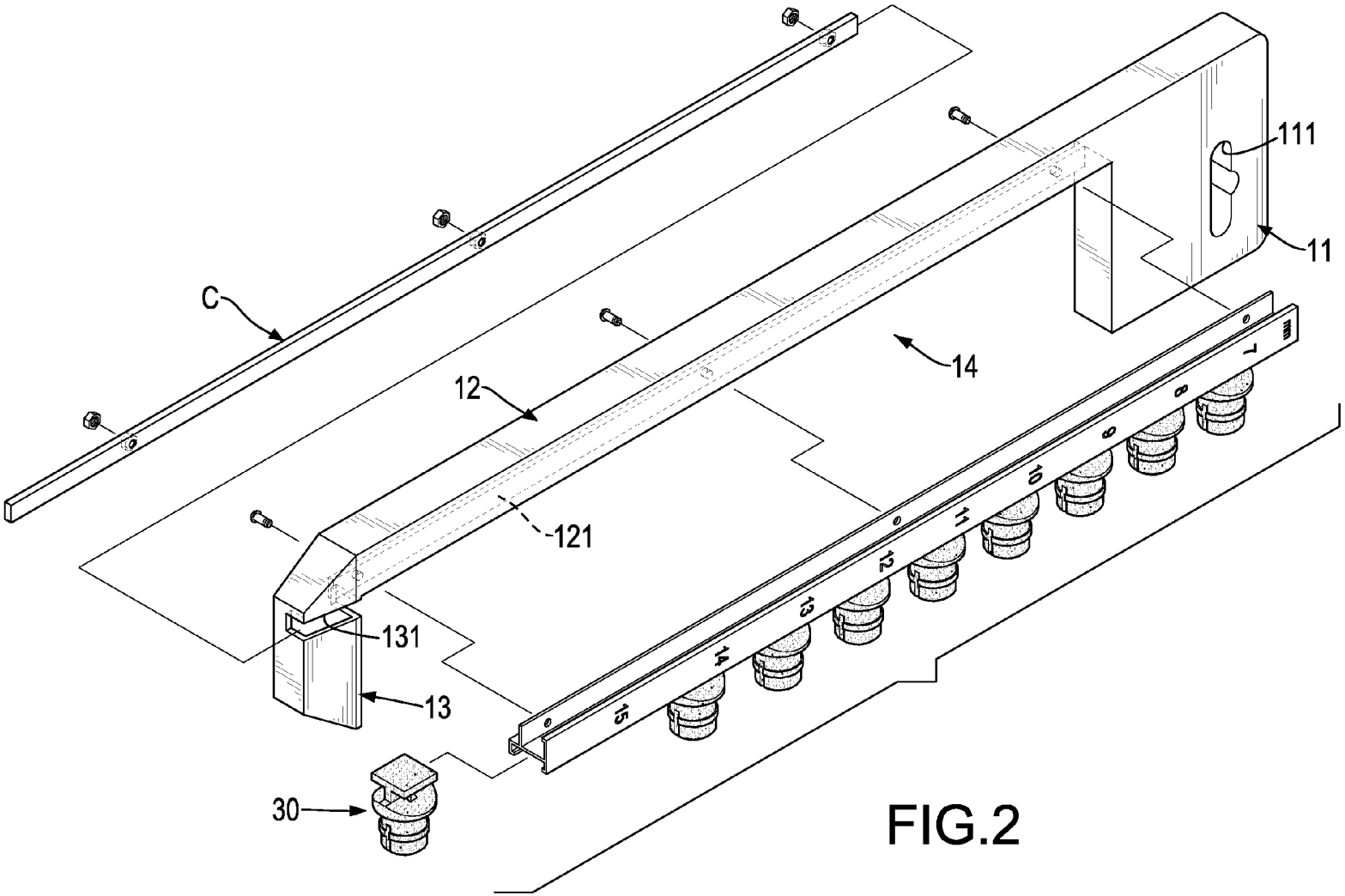
FIG. 2 is a partially exploded perspective view of the bit socket bracket assembly with a tool in FIG. 1.
Figure 3:
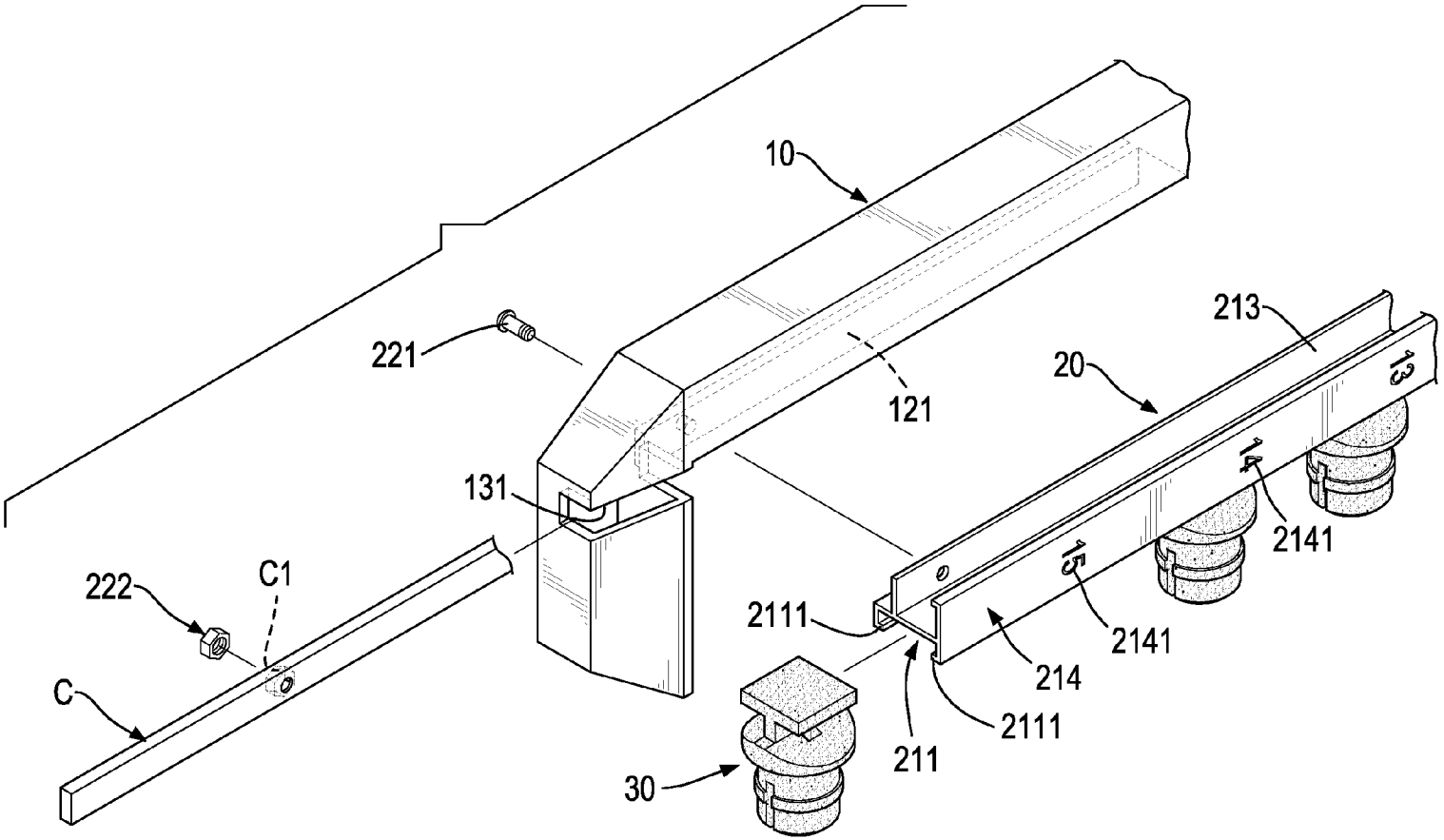
FIG. 3 is an enlarged and partially exploded perspective view of the bit socket bracket assembly with the tool in FIG. 2.
Figure 11:
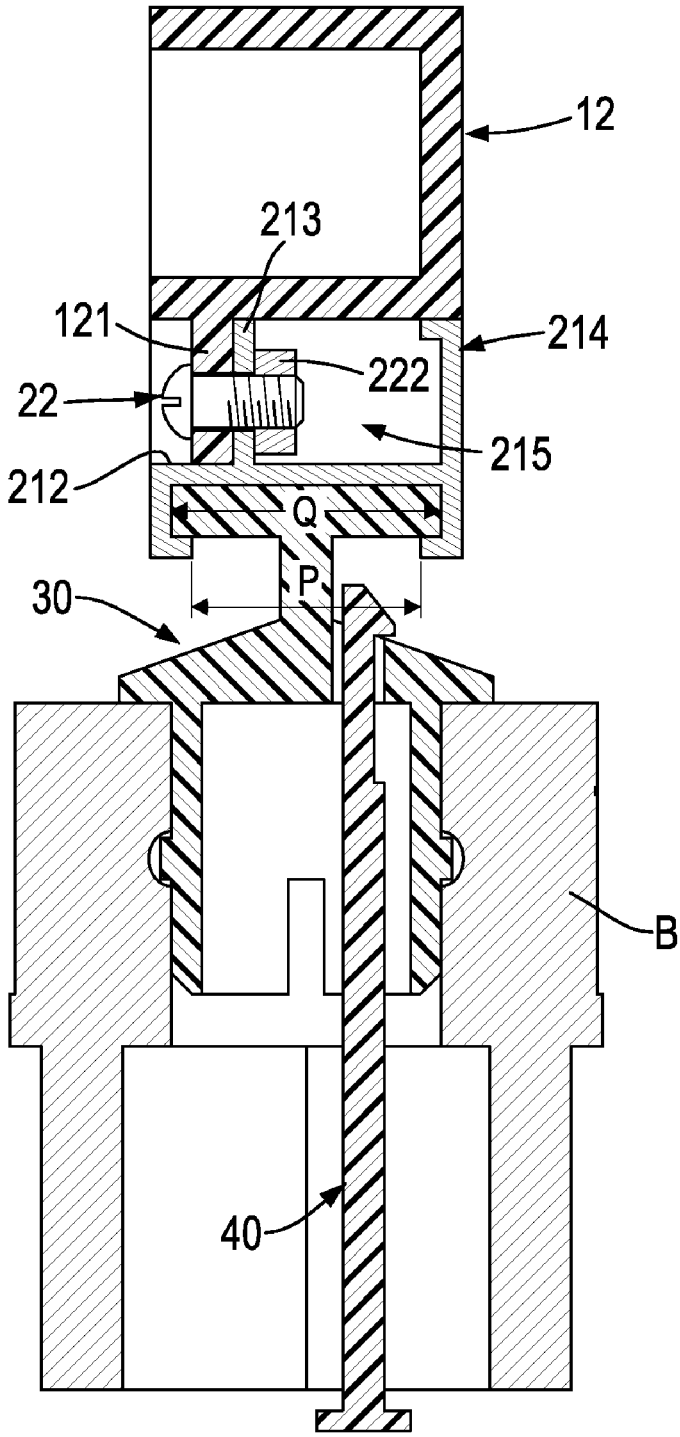
FIG. 11 is an enlarged side view in partial section of the bit socket bracket assembly in FIG. 10 along a line 11-11.
Figure 12:
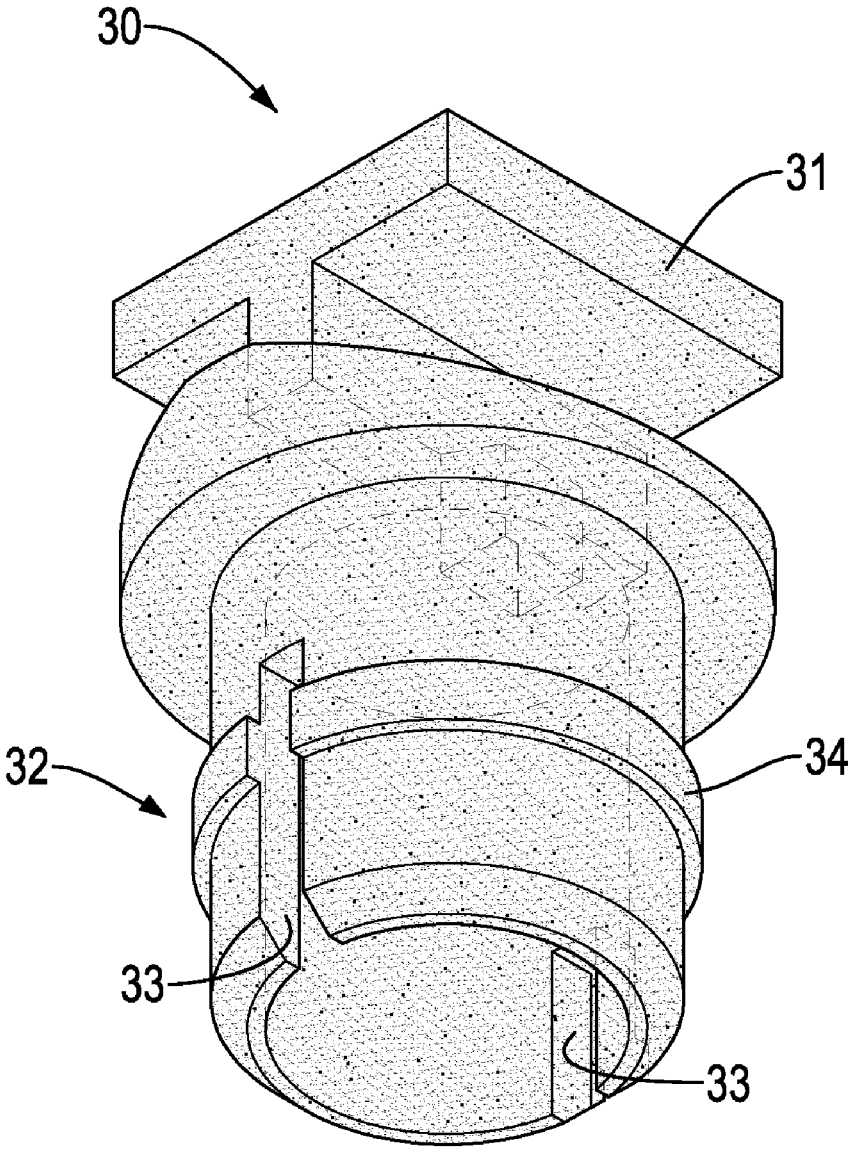
FIG. 12 is an enlarged perspective view of a bit socket bracket of the bit socket bracket assembly in FIG. 1.
Figure 13:
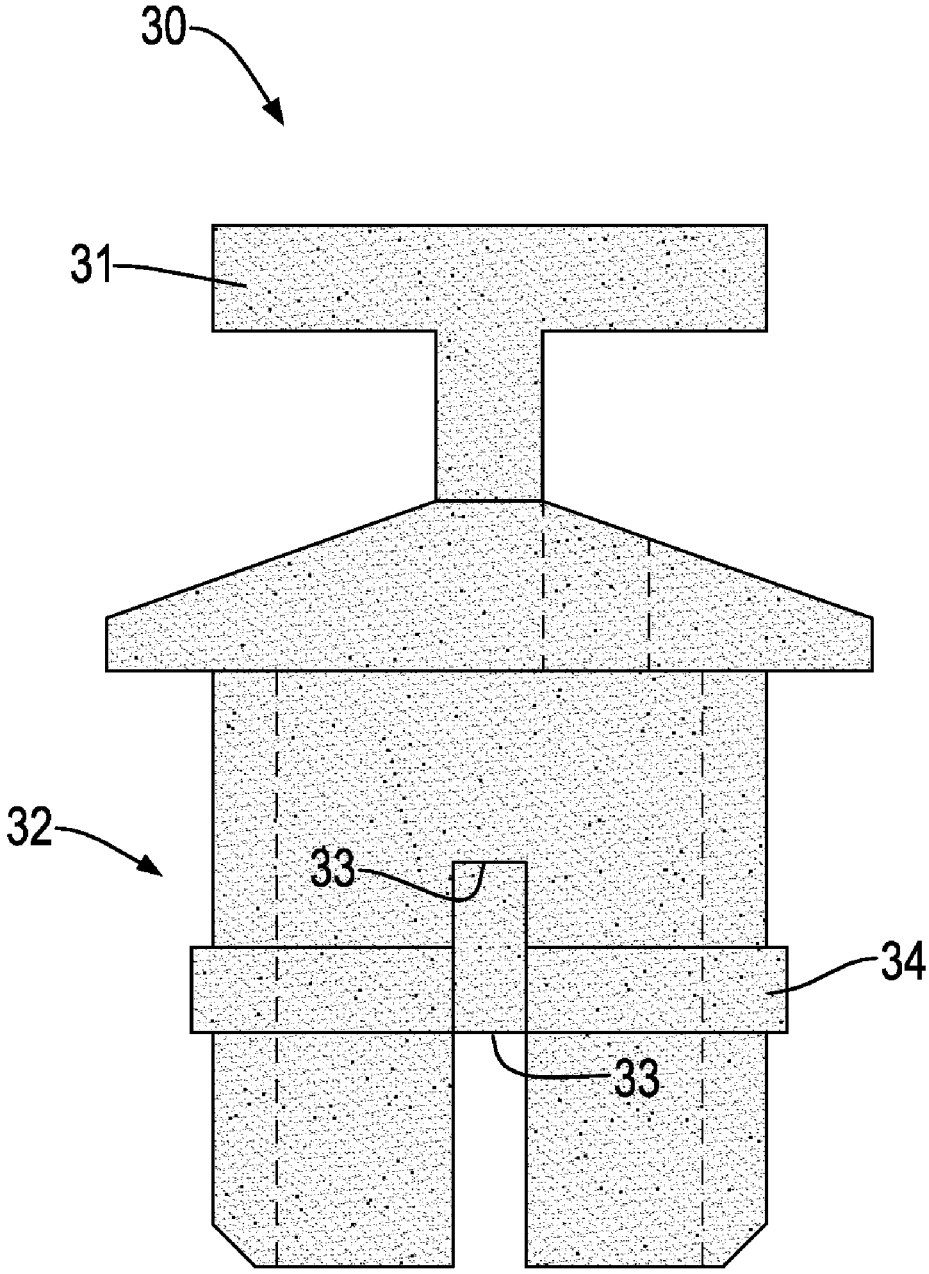
FIG. 13 is an enlarged side view of the bit socket bracket of the bit socket bracket assembly in FIG. 12.
Figure 14:
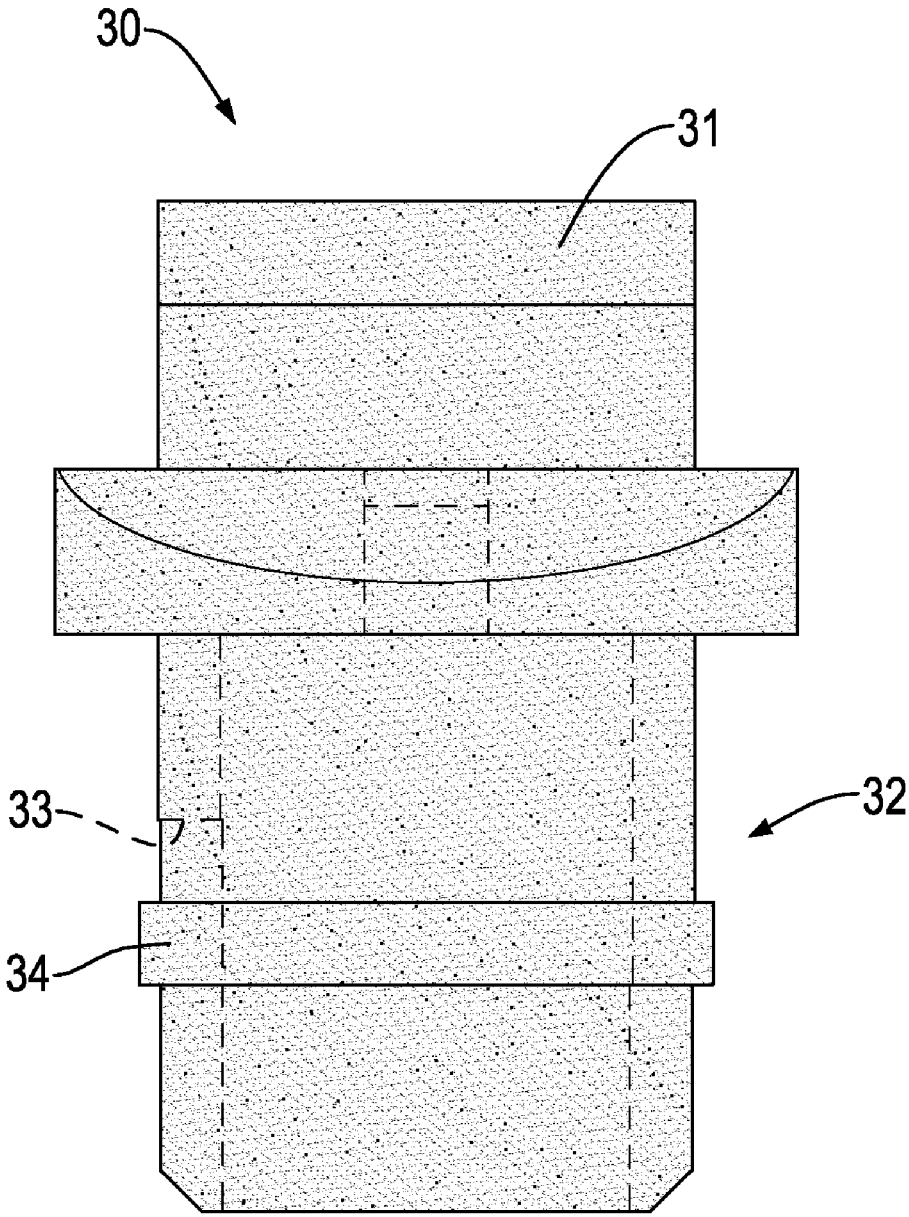
FIG. 14 is an enlarged front view of the bit socket bracket of the bit socket bracket assembly in FIG. 12.

With reference to FIGS. 2, 3 and 11, the track frame 20 is made of metal, preferably aluminum. The track frame 20 is mounted in the frame space 14, is securely connected with the main frame 10 and has a main body 21 and multiple fasteners 22.

The main body 21 is elongated and has a length, an extending direction, a track groove 211, a first width P, a second width Q, a connecting surface 212, a connecting strip 213, a display strip 214 and a tool space 215. The length of the main body 21 is the same as that of the arm 12. The extending direction of the main body 21 is the same as that of the arm 12.

The track groove 211 is opposite to the arm 12, is formed in the main body 21 and has two opposite inner surfaces, two edges and two limiting ribs 2111. The limiting ribs 2111 are respectively and integrally formed on the edges of the track grooves 211. Each limiting rib 2111 has a length and an extending direction respectively the same as those of the arm 12.

The first width P is defined as a distance between the limiting ribs 2111. The second width Q is defined as a distance between the inner surfaces of the track groove 211 and is larger than the first width P.

The connecting surface 212 faces the arm 12 and is opposite to the track groove 211.

The connecting strip 213 is integrally mounted on the connecting surface 212 and abuts the mounting strip 121.

The display strip 214 is integrally mounted on the connecting surface 212 beside the connecting strip 213 and has an outer surface and multiple signs 2141. The outer surface of the display strip 214 is opposite to the connecting strip 213. The signs 2141 are formed on the outer surface of the display strip 214 at intervals.

The tool space 215 is formed between the connecting strip 213 and the display strip 214 and aligns with, is adjacent to and communicates with the tool channel 131.

Each fastener 22 is mounted through the mounting strip 121 and the connecting strip 213 and has a bolt 221 and a nut 222 connected with the bolt 221. A distance is formed between each fastener 22 and the display strip 214. Preferably, the nut 222 of each fastener 20 is located in the tool space 215.

With reference to FIGS. 2, 3, 12, 13 and 14, the bit socket brackets 30 are hollow, and are slidably connected with the track groove 211. The number of the bit socket brackets 30 is the same as that of the signs 2141 and the bit socket brackets 30 respectively correspond to the signs 2141. Each bit socket bracket 30 has a sliding section 31, a positioning section 32, two bracket grooves 33 and an engaging flange 34.

Take one bit socket bracket 30 for example. The sliding section 31 is slidably mounted in the track groove 211 and has a rectangular cross section to make the sliding section 31 not rotatable. Because the first width P is smaller than the second width Q, each bit socket bracket 30 does not fall off from the main frame 10.

The positioning section 32 is hollow, is integrally mounted on the sliding section 31 of the bit socket bracket 30 and has an end surface, an outer surface, a cross section and a bracket recess. The end surface of the positioning section 32 of the bit socket bracket 30 is opposite to the sliding section 31 of the bit socket bracket 30. The cross section of the positioning section 32 is round. The bracket recess of the positioning section 32 of the bit socket bracket 30 is axially formed in the end surface of the positioning section 32 and has a cross section, an opening and a bottom. The cross section of the bracket recess of the positioning section 32 is round. The bottom of the bracket recess of the positioning section 32 is opposite to the opening of the bracket recess and is adjacent to the sliding section 31.

The bracket grooves 33 are formed in the end surface of the positioning section 32, communicate with the bracket recess and are respectively located at two opposite sides of the positioning section 32.

The engaging flange 34 is annular and is formed around the outer surface of the positioning section 32. One of the two bracket grooves 33 of the bit socket bracket 30 is formed through the engaging flange 34 of the bit socket bracket 30.

Figure 5:
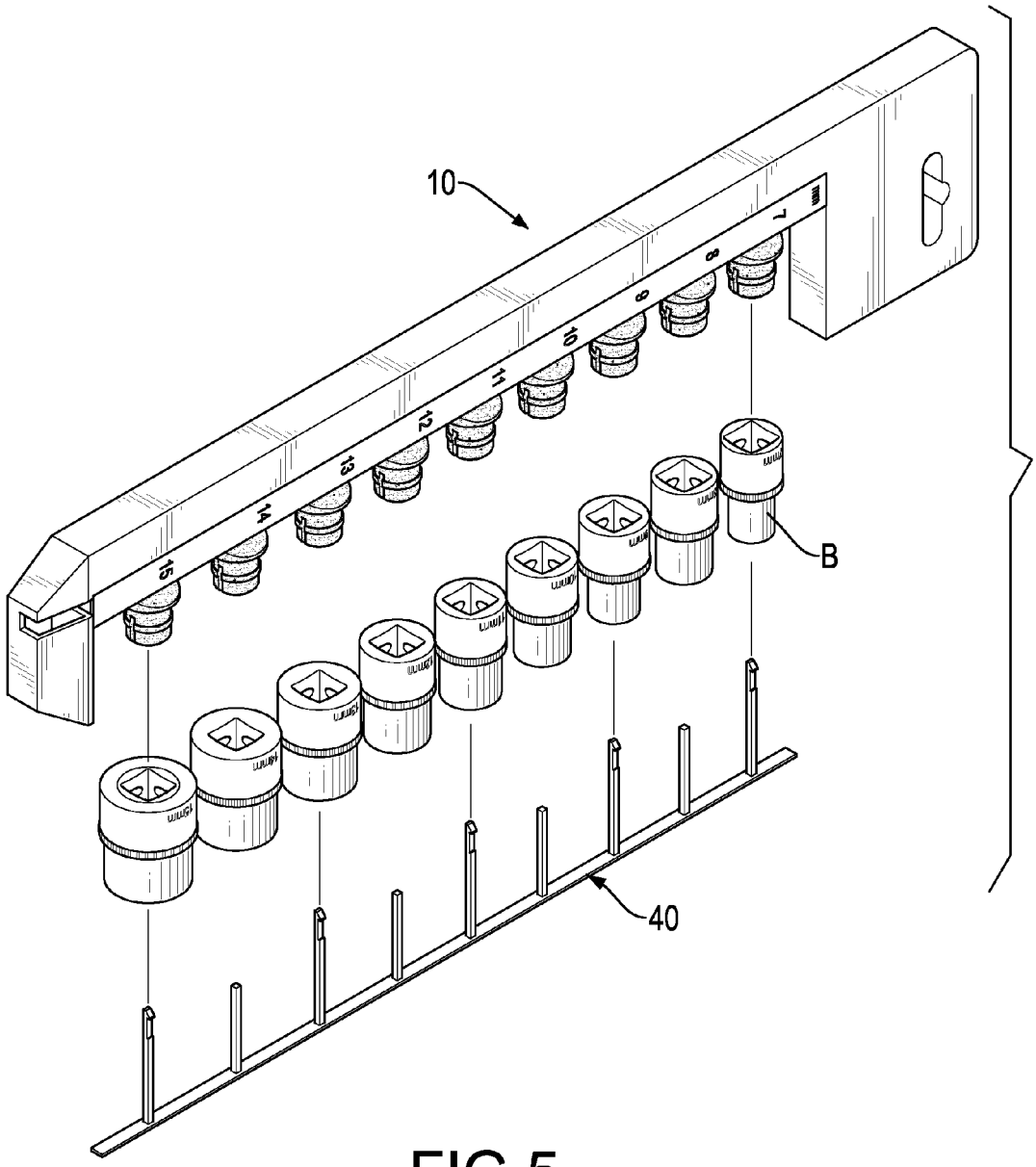
FIG. 5 is a partially exploded perspective view of the bit socket bracket assembly in FIG. 1.
Figure 8:
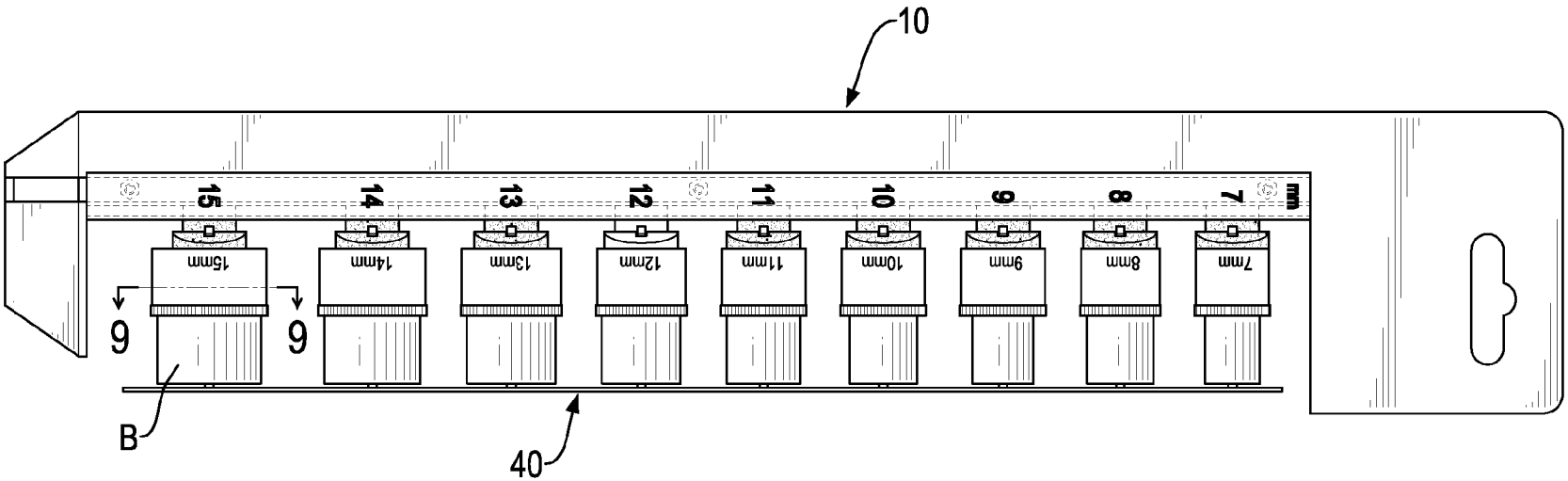
FIG. 8 is a front view of the bit socket bracket assembly in FIG. 1.
Figure 9:
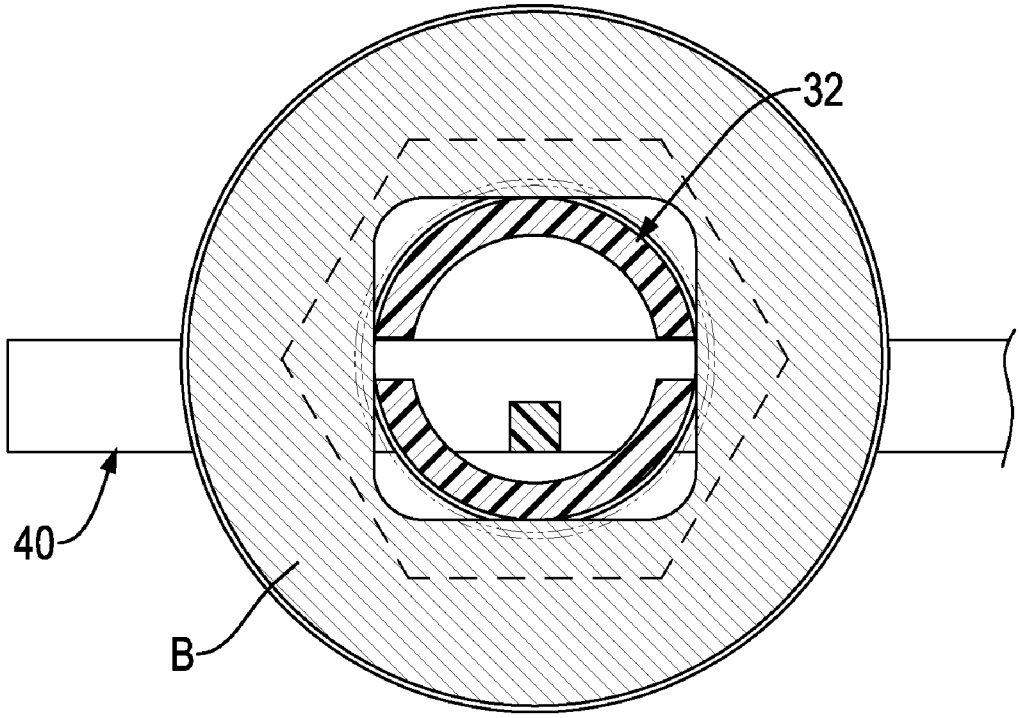
FIG. 9 is an enlarged cross sectional top view of the bit socket bracket assembly in FIG. 8 along a line 9-9.
Figure 10:
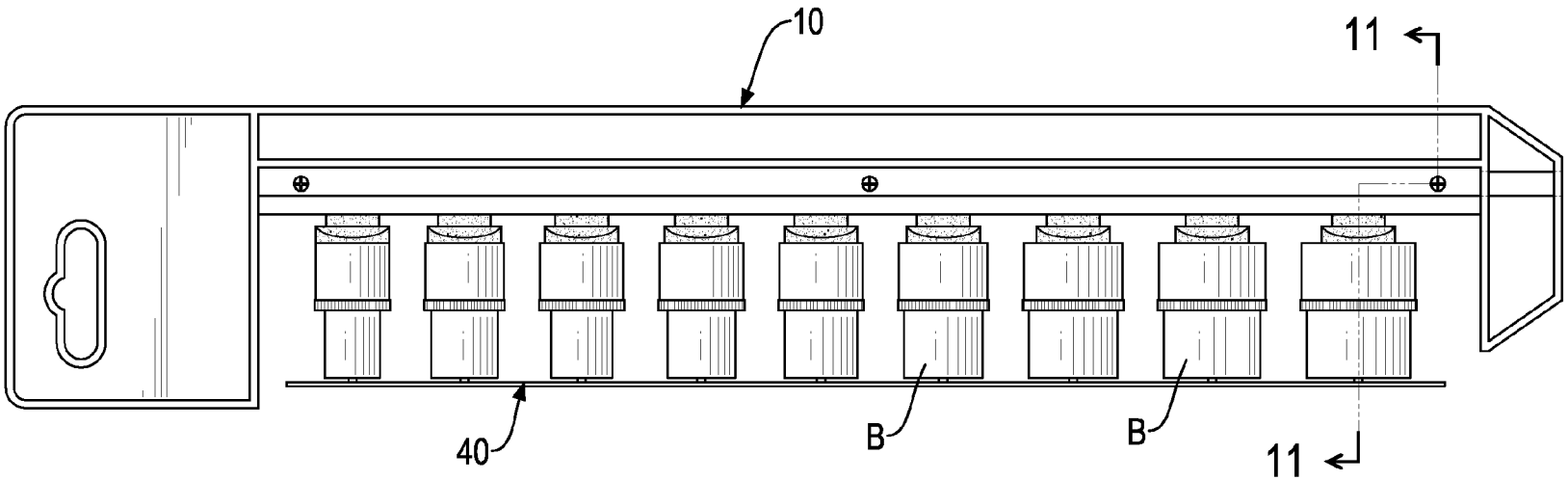
FIG. 10 is a rear view of the bit socket bracket assembly in FIG. 1.

With reference to FIGS. 5, 8 and 11, the burglarproof unit 40 is elongated and is connected with each bit socket bracket 30. The bit socket brackets 30 and the burglarproof unit 40 may be conventional and detailed description is omitted.

With reference to FIGS. 2 and 3, in assembling, the sliding sections 31 of the bit socket brackets 30 are in sequence slid into the track groove 211 of the track frame 20.

A tool C is prepared. The tool C is a metallic strip and has multiple nut holes C1 formed in the tool C at intervals. The number of the nut holes C1 is the same as that of the nuts 222 of the fasteners 22. The nuts 222 are respectively placed in the nut holes C1. The tool C carrying the nuts 222 is then slid through the tool channel 131 into the tool space 215.

Figure 4:
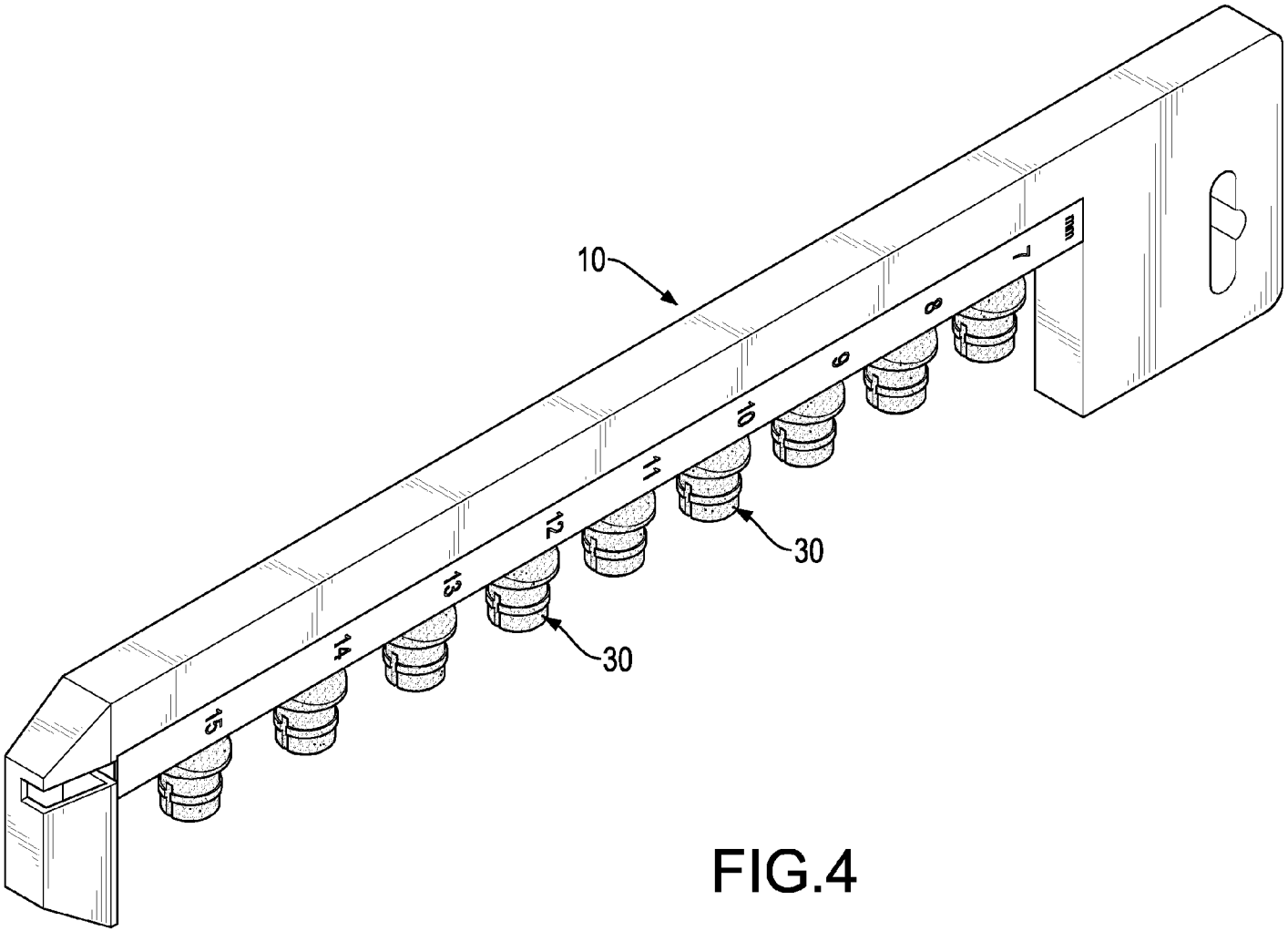
FIG. 4 is a perspective view of the bit socket bracket assembly in FIG. 1, showing a burglarproof unit is removed.
Figure 15:
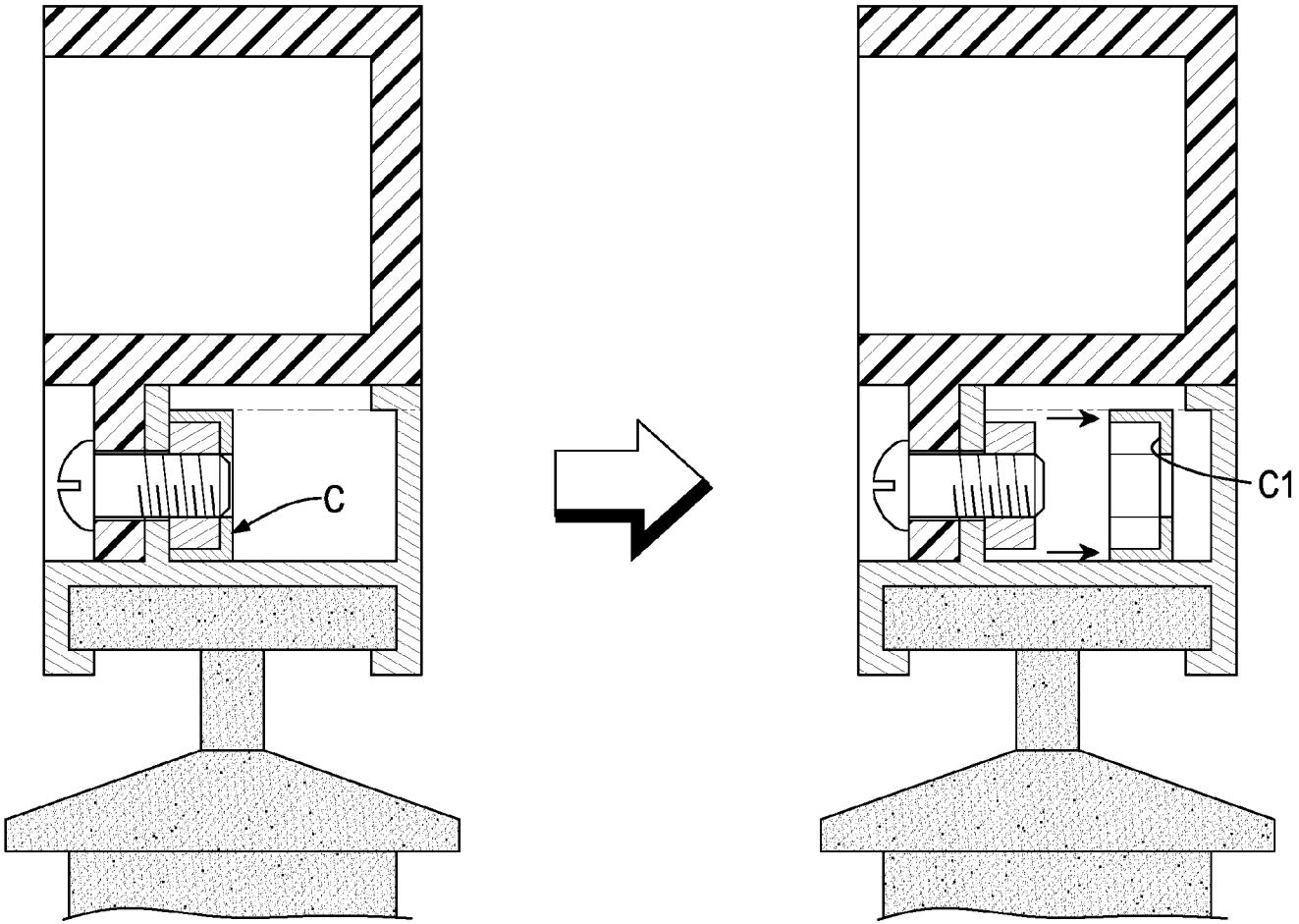
FIG. 15 is enlarged operational side views in partial section of the bit socket bracket assembly in FIG. 3, showing the tool is moved toward the display strip.

With further reference to FIGS. 4 and 15, the mounting strip 121 of the main frame 10 abuts the connecting strip 213 of the track frame 20. The bolt 221 of each fastener 22 is mounted through the mounting strip 121 and the connecting strip 213 and is screwed into the nut 222 of the fastener 22. Because there is the distance between each fastener 22 and the display strip 214, the tool C can be moved toward the display strip 214. Consequently, the tool C is pulled through the tool channel 131.

Figure 6:
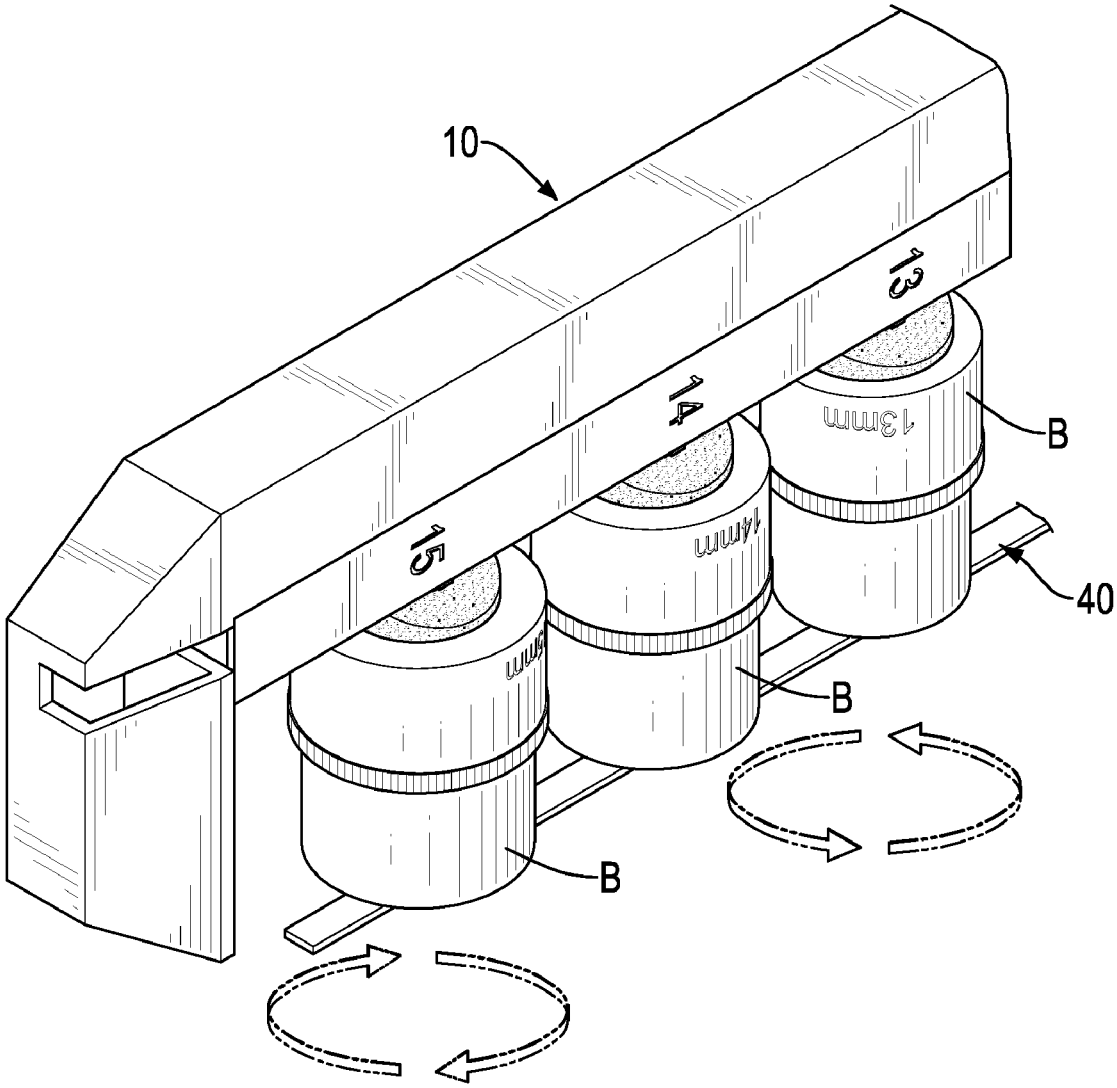
FIG. 6 is an enlarged operational perspective view of the bit socket bracket assembly in FIG. 1.
Figure 7:
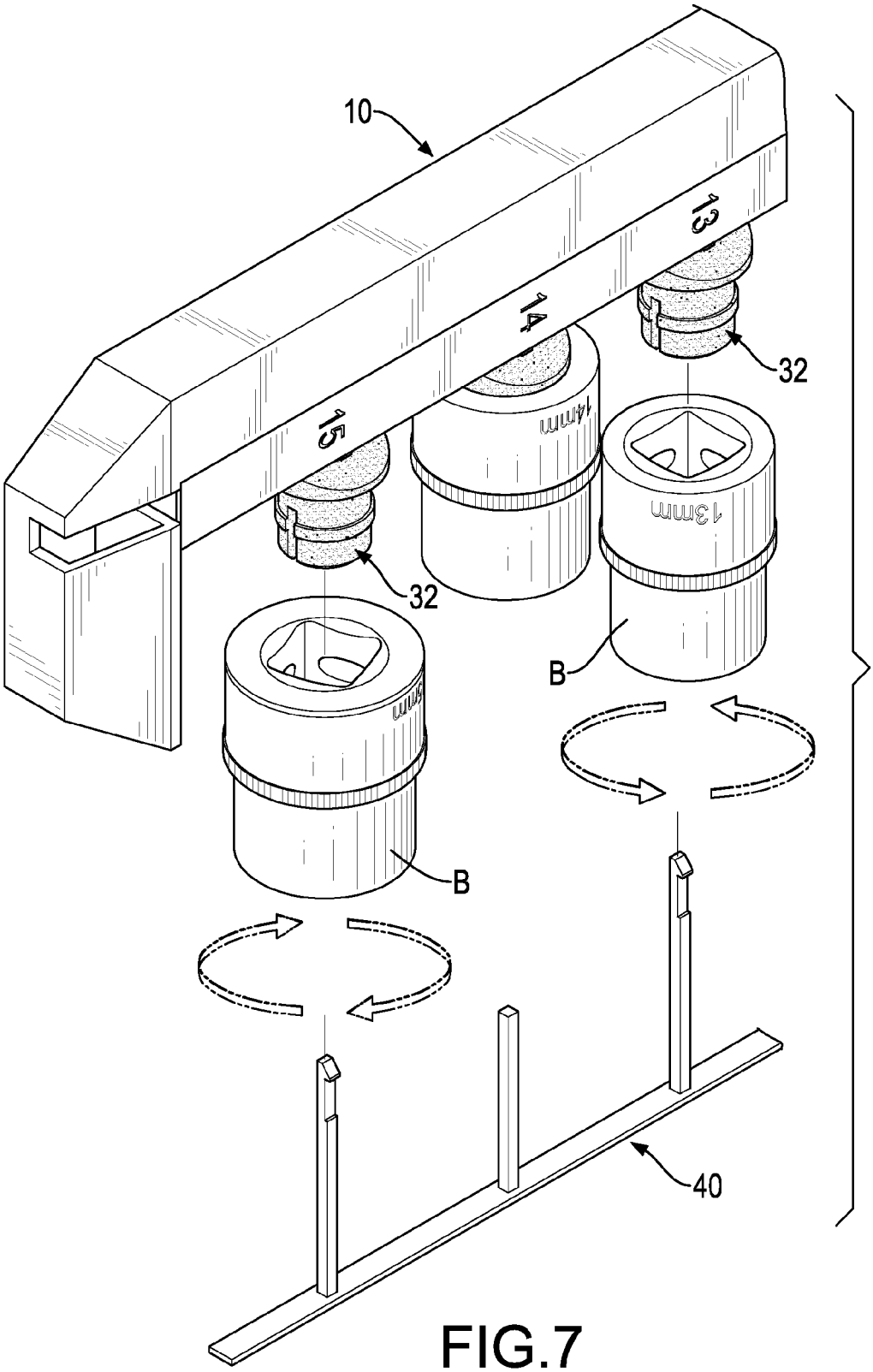
FIG. 7 is an enlarged operational exploded perspective view of the bit socket bracket assembly in FIG. 5.

With reference to FIGS. 5 to 7, bit sockets B are respectively mounted around the positioning sections 32 of the bit socket brackets 30. Consequently, the burglarproof unit 40 is then connected with each bit socket bracket 30.

With reference to FIGS. 6 to 9, the bit sockets B can be rotated because the cross sections of the positioning sections 32 are round. Accordingly, a number or a sign on each bit socket B can be rotated to face a user. When the bit sockets B rotate, the bit sockets B do not interfere with the burglarproof unit 40.

Figure 16:
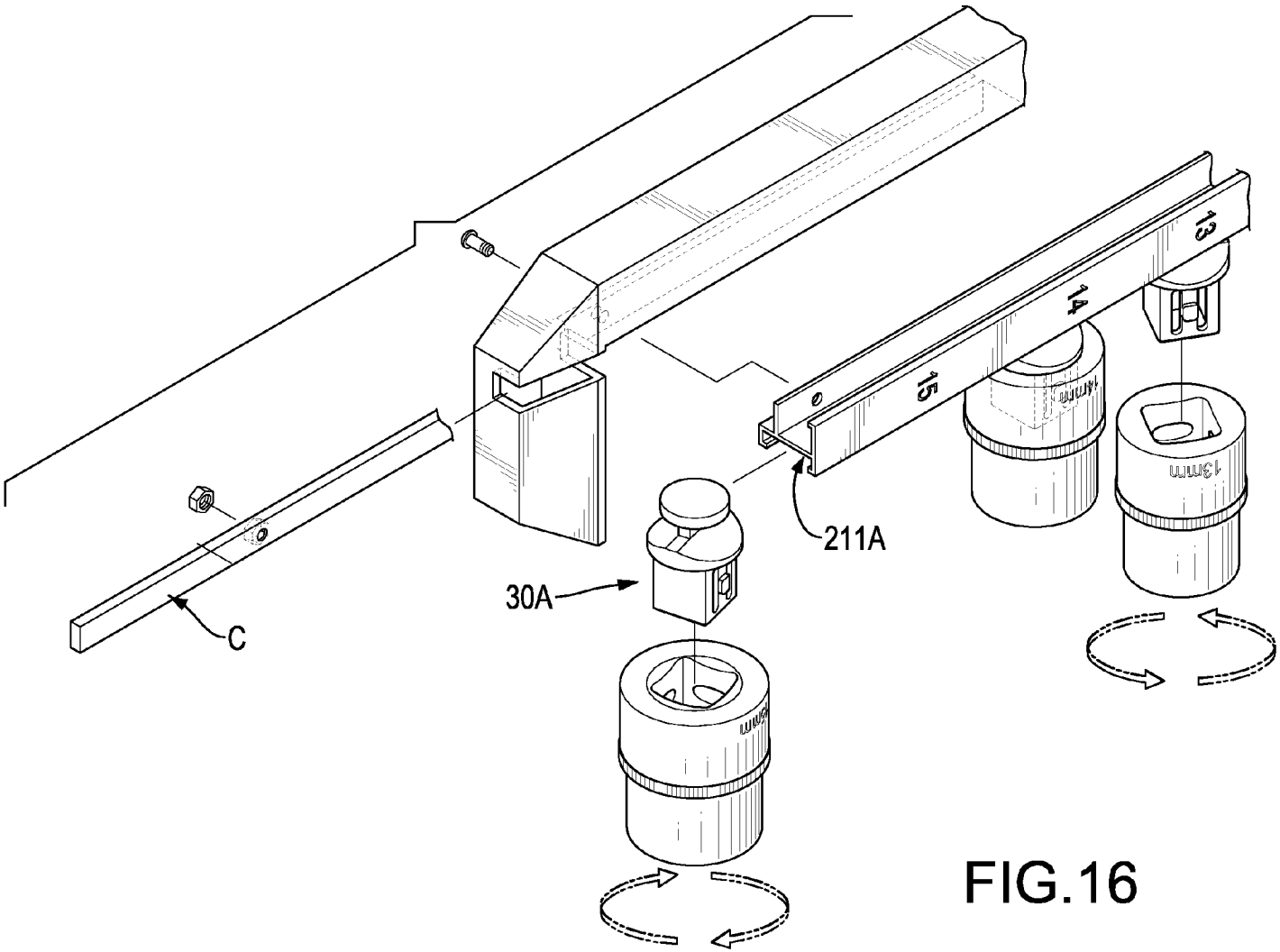
FIG. 16 is an enlarged and partially exploded perspective view of a second embodiment of the bit socket bracket assembly in accordance with the present invention with the tool.
Figure 17:
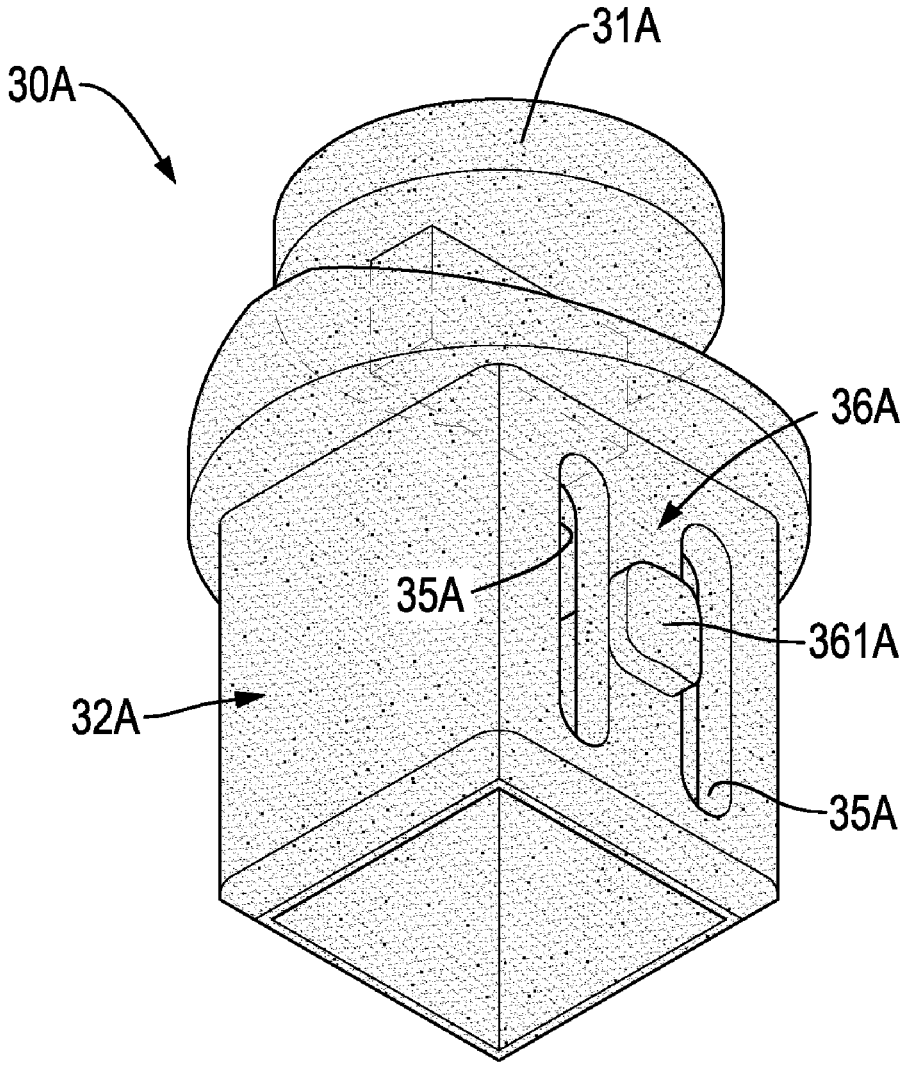
FIG. 17 is an enlarged perspective view of the bit socket bracket of the bit socket bracket assembly in FIG. 16.

With reference to FIGS. 16 and 17, a second embodiment of the bit socket bracket assembly is substantially the same as the first embodiment except the structures of the bit socket brackets 30A are different.

Take one of the bit socket brackets 30A for example. Each bit socket bracket 30A has a sliding section 31A, a positioning section 32A, two through grooves 35A and an engaging strip 36A. The sliding section 31A is slidably mounted in the track groove 211A and has a round cross section to make the sliding section 31A rotatable. The positioning section 32A is hollow, is integrally mounted on the sliding section 31A of the bit socket bracket 30A and has a side surface, an end surface, an outer surface, a cross section and a bracket recess. The end surface of the positioning section 32A is opposite to the sliding section 31A of the bit socket bracket 30A. The cross section of the bit socket bracket 30A is rectangular. The bracket recess of the bit socket bracket 30A is formed in the end surface of the positioning section 32A and has a cross section, an opening and a bottom. The cross section of the bracket recess of the bit socket bracket 30A is rectangular. The bottom of the bracket recess of the bit socket bracket 30A is opposite to the opening of the bracket recess and is adjacent to the sliding section 31A.

The through grooves 35A are formed through the side surface of the positioning section 32A and communicate with the bracket recess.

The engaging strip 36A is formed between the through grooves 35A of the bit socket bracket 30A and has a protruding and retractable button 361A. Accordingly, the bit sockets B can be pressed against by the buttons 361A for secure positioning.

After the burglarproof unit 40 is detached from the bit socket brackets 30, the bit sockets B can be rotated and a number or a sign on each bit socket B can be rotated to face a user.

From the above description, it is noted that the present invention has the following advantages:

1. Enhanced Structural Strength:

Because the main frame 10 and the track frame 20 are two separate members, the track frame 20 can be made of metal. Accordingly, the structural strength of the bit socket bracket assembly is enhanced. Moreover, the signs 2141 are not easily worn off.

2. Easy Arrangement:

The signs 2141 are formed on the display strip 214 by laser and facilitate a user's recognizing, taking or arranging the bit sockets B.

3. Attracting Consumers:

Because the track frame 20 is made of metal and has a metallic luster, the luster can attract users to purchase the bit socket bracket assembly in accordance with the present invention.

What is claimed is:

1. A bit socket bracket assembly comprising:

a main frame made of plastic and having;

a base plate having a hanging hole formed through the base plate;

an arm integrally mounted on the base plate and having a length;

an extending direction;

an elongated side surface;

a mounting strip protruding from the side surface; and a distal end opposite to the base plate;

a limiting member integrally mounted on the distal end of the arm and having a tool channel formed through the limiting member; and a frame space formed between the base plate, the arm and the limiting member and having a rectangular cross section, wherein the mounting strip is located in the frame space;

a track frame made of metal, mounted in the frame space, securely connected with the main frame and having an elongated main body having a length the same as that of the arm;

an extending direction the same as that of the arm;

a track groove opposite to the arm and formed in the main body and having two opposite inner surfaces;

two edges; and two limiting ribs respectively and integrally formed on the edges of the track grooves, each limiting rib having a length and an extending direction respectively the same as those of the arm;

a first width defined as a distance between the limiting ribs;

a second width defined as a distance between the inner surfaces of the track groove and larger than the first width;

a connecting surface facing the arm and opposite to the track groove;

a connecting strip integrally mounted on the connecting surface and abutting the mounting strip;

a display strip integrally mounted on the connecting surface beside the connecting strip and having an outer surface opposite to the connecting strip; and multiple signs formed on the outer surface of the display strip at intervals; and a tool space formed between the connecting strip and the display strip, aligning, adjacent to and communicating with the tool channel; and multiple fasteners, each fastener mounted through the mounting strip and the connecting strip and having a bolt and a nut connected with the bolt, wherein a distance is formed between each fastener and the display strip;

multiple hollow bit socket brackets slidably connected with the track groove, wherein the number of the bit socket brackets is the same as that of the signs and the bit socket brackets respectively correspond to the signs, each bit socket bracket having a sliding section slidably mounted in the track groove and having a rectangular cross section to make the sliding section unable to rotate;

a hollow positioning section integrally mounted on the sliding section of the bit socket bracket and having an end surface opposite to the sliding section of the bit socket bracket;

an outer surface;

a round cross section; and a bracket recess axially formed in the end surface of the positioning section and having a round cross section;

an opening; and a bottom opposite to the opening of the bracket recess and adjacent to the sliding section;

two bracket grooves formed in the end surface of the positioning section, communicating with the bracket recess and respectively located at two opposite sides of the positioning section; and a retractable annular engaging flange formed around the outer surface of the positioning section, wherein one of the two bracket grooves of each bit socket bracket is formed through the engaging flange of the bit socket bracket; and an elongated burglarproof unit connected with each bit socket bracket.

2. The bit socket bracket assembly as claimed in claim 1, wherein the nut of each fastener is located in the tool space.

3. A bit socket bracket assembly comprising:

a main frame made of plastic and having;

a base plate having a hanging hole formed through the base plate;

an arm integrally mounted on the base plate and having a length;

an extending direction;

an elongated side surface;

a mounting strip protruding from the side surface; and a distal end opposite to the base plate;

a limiting member integrally mounted on the distal end of the arm and having a tool channel formed through the limiting member; and a frame space formed between the base plate, the arm and the limiting member and having a rectangular cross section, wherein the mounting strip is located in the frame space;

a track frame made of metal, mounted in the frame space, securely connected with the main frame and having an elongated main body having a length the same as that of the arm;

an extending direction the same as that of the arm;

a track groove opposite to the arm and formed in the main body and having two opposite inner surfaces;

two edges; and two limiting ribs respectively and integrally formed on the edges of the track grooves, each limiting rib having a length and an extending direction respectively the same as those of the arm;

a first width defined as a distance between the limiting ribs;

a second width defined as a distance between the inner surfaces of the track groove and larger than the first width;

a connecting surface facing the arm and opposite to the track groove;

a connecting strip integrally mounted on the connecting surface and abutting the mounting strip;

a display strip integrally mounted on the connecting surface beside the connecting strip and having an outer surface opposite to the connecting strip; and multiple signs formed on the outer surface of the display strip at intervals; and a tool space formed between the connecting strip and the display strip, aligning, adjacent to and communicating with the tool channel; and multiple fasteners, each fastener mounted through the mounting strip and the connecting strip and having a bolt and a nut connected with the bolt, wherein a distance is formed between each fastener and the display strip;

multiple hollow bit socket brackets slidably connected with the track groove, wherein the number of the bit socket brackets is the same as that of the signs and the bit socket brackets respectively correspond to the signs, each bit socket bracket having a sliding section slidably mounted in the track groove and having a round cross section to make the sliding section rotatable;

a hollow positioning section integrally mounted on the sliding section of the bit socket bracket and having a side surface;

an end surface opposite to the sliding section of the bit socket bracket;

an outer surface;

a rectangular cross section; and a bracket recess formed in the end surface of the positioning section and having a rectangular cross section;

an opening; and a bottom opposite to the opening of the bracket recess and adjacent to the sliding section;

two through grooves formed through the side surface of the positioning section and communicating with the bracket recess; and an engaging strip formed between the through grooves of the bit socket bracket and having a protruding and retractable button; and an elongated burglarproof unit connected with each bit socket bracket.

4. The bit socket bracket assembly as claimed in claim 3, wherein the nut of each fastener is located in the tool space.

* * * * *